US009546335B2

(12) United States Patent
Obrecht et al.

(10) Patent No.: US 9,546,335 B2
(45) Date of Patent: Jan. 17, 2017

(54) ENGINE LUBRICANT COMPOSITION

(75) Inventors: Nicolas Obrecht, Lyons (FR); Julien Guerin, Lyons (FR); Nadjet Khelidj, Horgen (CH)

(73) Assignees: DOW GLOBAL TECHNOLOGIES LLC, Midland, MI (US); TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 13/988,902

(22) PCT Filed: Nov. 24, 2011

(86) PCT No.: PCT/IB2011/055269

§ 371 (c)(1),
(2), (4) Date: May 22, 2013

(87) PCT Pub. No.: WO2012/070007

PCT Pub. Date: May 31, 2012

(65) Prior Publication Data

US 2013/0244917 A1 Sep. 19, 2013

(30) Foreign Application Priority Data

Nov. 26, 2010 (FR) ..... 10 59815

(51) Int. Cl.

| | |
|---|---|
| ***C10M 107/24*** | (2006.01) |
| ***C10M 169/04*** | (2006.01) |
| ***C10M 129/50*** | (2006.01) |
| ***C10M 159/22*** | (2006.01) |

(52) U.S. Cl.

CPC ..... *C10M 107/24* (2013.01); *C10M 169/04* (2013.01); *C10M 2207/023* (2013.01); *C10M 2207/026* (2013.01); *C10M 2207/262* (2013.01); *C10M 2209/1033* (2013.01); *C10M 2215/064* (2013.01); *C10M 2219/068* (2013.01); *C10N 2220/022* (2013.01); *C10N 2230/02* (2013.01); *C10N 2230/74* (2013.01); *C10N 2240/10* (2013.01)

(58) Field of Classification Search

CPC ..... C10M 107/24; C10M 169/04; C10M 2207/023; C10M 2207/026; C10M 2207/262; C10M 2209/1033; C10M 2215/064; C10M 2219/068; C10N 2230/02; C10N 2230/022; C10N 2230/74; C10N 2240/10

USPC ..... 508/444, 579, 494, 502, 583

See application file for complete search history.

(56) References Cited

U.S. PATENT DOCUMENTS

| | | | | |
|---|---|---|---|---|
| 2,620,302 | A | 12/1952 | Harle | |
| 4,997,969 | A | 3/1991 | Luciani | |
| 5,198,135 | A * | 3/1993 | Galic | C10M 145/32 508/398 |
| 5,808,145 | A | 9/1998 | Le Coent et al. | |
| 5,885,555 | A | 3/1999 | Sheehan | |
| 6,348,438 | B1 | 2/2002 | Le Coent et al. | |
| 7,160,845 | B2 | 1/2007 | Baranski et al. | |
| 7,838,474 | B2 | 11/2010 | Boffa | |
| 8,188,020 | B2 | 5/2012 | Le Coent et al. | |
| 8,535,514 | B2 | 9/2013 | Carey et al. | |
| 2005/0256014 | A1 | 11/2005 | Sherman et al. | |
| 2008/0280791 | A1 | 11/2008 | Hewette | |
| 2009/0111721 | A1 * | 4/2009 | Boffa | 508/371 |
| 2009/0186784 | A1 * | 7/2009 | Diggs | C10M 167/00 508/155 |
| 2013/0157909 | A1 * | 6/2013 | Greaves et al. | 508/282 |

FOREIGN PATENT DOCUMENTS

| | | | | |
|---|---|---|---|---|
| CH | WO 2011037778 | A1 * | 3/2011 | C09K 8/34 |
| FR | 2817874 | A1 | 6/2002 | |
| JP | 54-159411 | | 12/1979 | |
| JP | 2007-106855 | | 4/2007 | |
| JP | 2007204451 | A | 8/2007 | |
| JP | 2010037441 | A | 2/2010 | |
| RU | 2147030 | C1 | 3/2000 | |
| WO | WO-2004009747 | A1 | 1/2004 | |
| WO | WO-2004041767 | A1 | 5/2004 | |
| WO | WO-2005007786 | A2 | 1/2005 | |
| WO | WO-2005113640 | A1 | 12/2005 | |
| WO | WO2007 061699 | A2 | 5/2007 | |

(Continued)

OTHER PUBLICATIONS

Japanese Office Action dated Jul. 21, 2015—English Translation.

*Primary Examiner* — James Goloboy

(74) *Attorney, Agent, or Firm* — Harness, Dickey & Pierce, P.L.C.

(57) ABSTRACT

Lubricant compositions include: (a) one or more polyalkylene glycol base oils obtained by polymerization or copolymerization of alkylene oxides comprising from 3 to 8 carbon atoms, include at least one butylene oxide and (b) at least one detergent chosen from salicylates or phenates. The present disclosure also relates to: 1) use of a lubricant composition as engine oil, preferably as oil for the engines of petrol or diesel motor vehicles; 2) use of a group of additives for an engine lubricant comprising polyalkylene glycol bases obtained by polymerization or copolymerization of alkylene oxides comprising from 3 to 8 carbon atoms; and 3) use of at least one additive chosen from salicylates, phenates, dithiocarbamates, amine-based or phenol-based antioxidants, preferably from salicylates or phenates, for reducing the Noack volatility of the base oils of polyalkylene glycol type, obtained from alkylene oxides comprising from 3 to 8 carbon atoms.

14 Claims, No Drawings

(56) References Cited

FOREIGN PATENT DOCUMENTS

| | | | |
|---|---|---|---|
| WO | WO-2009134638 | A2 | 11/2009 |
| WO | WO-2009134716 | A1 | 11/2009 |
| WO | WO-2011011656 | A2 | 1/2011 |

* cited by examiner

ENGINE LUBRICANT COMPOSITION

CROSS-REFERENCE TO RELATED APPLICATIONS

This application is a National Phase Entry of International Application No. PCT/IB2011/055269, filed on Nov. 24, 2011, which claims priority to French Patent Application Serial No. 1059815, filed on Nov. 26, 2010, both of which are incorporated by reference herein.

TECHNICAL FIELD

The present invention relates to lubricant compositions for engines, notably for gasoline or diesel automobile engines.

BACKGROUND

Lubricant compositions used as a motor oil conventionally comprise from 50 to 90% of base oils, which may be of mineral, synthetic or natural origin, and additives. These additives are typically detergents, dispersants, antioxidants, polymers enhancing the viscosity index (VI) (VI improver), friction modifiers, flowpoint-lowering agents, anti-foam agents . . . . The synthetic bases are for example polyalphaolefins, gas-to-liquids (GTL) bases for example obtained by Fischer-Tropsch methods, or certain esters.

Another category of synthetic base oils is formed by polyalkylene glycols (PAGs). These latter bases are for example obtained by polymerization or copolymerization of alkylene oxides, preferentially comprising between 2 and 8 carbon atoms. Methods for producing PAG bases are for example described in applications WO2009/134716 and WO2009/134638.

The use of PAG bases in motor oils, notably for automobile engines, has a certain number of benefits, notably because of their good tribological and rheological properties, but also because they are polar bases. They are therefore capable of properly solubilizing certain additives required for formulating a motor oil on the one hand, which would make these additives efficient at lower contents, whence an economic gain. On the other hand, they are capable of also solubilizing solid contaminants which are formed during the use of the oil in the engine, whence a gain in engine cleanliness.

However, the use of these PAG bases in an engine lubricant comes up against a difficulty. Their Noack volatility, measured according to the CEG L 40-93 standard is very high which does not allow their incorporation in motor oil formulations, notably in a large amount and even less as exclusive base oils. Another difficulty comes from the low solubility of PAG bases in oily compounds, notably in the other base oils, which does not make them very suitable for use in a motor oil formulation. The PAGs are mainly known for their use as base fluids in oils for compressors in cooling systems. However, the state of the art contains a few examples of other uses of PAGs, for example in motor oils, for example automobile or marine engines.

Application WO2009/134716 thus discloses an oil for an automobile engine comprising at least one polyalkylene glycol base oil adapted to a use in automobile engines, combined with an additive package comprising derivatives of aspartic acid, and optionally anti-wear additives, anti-corrosion agents, antioxidants, friction modifiers, anti-foam agents. No mention is made of the presence of detergent additives in said compositions.

Application WO2009/134638 discloses a lubricant composition for an internal combustion engine comprising polyalkylene glycols obtained by copolymerization of ethylene oxide and of an alkylene oxide having up to 12 carbon atoms, comprising between 1 and 50 alkylene oxide units, and optionally a VI enhancer polymer. No mention is made of other additives present in the disclosed compositions.

Application FR 2817874 discloses functional fluids for automobiles, notably for automobile engines, comprising polyalkylene glycol bases and a reducing agent which may be urea. These PAGs are in particular obtained from ethylene and propylene oxide. No specific mention is made of other PAG bases, nor of other additives used in combination with the PAG bases.

U.S. Pat. No. 5,885,555 discloses a composition for the formulation of toothpastes comprising polyalkylene glycols and methyl salicylate, a so-called "wintergreen" toothpastes. The latter compound is not at all similar to the detergents of the salicylate type used in lubricant compositions, for example in motor oils, where the benzene ring of salicylic acid comprises hydrocarbon substituants with sufficiently long chains for forming the lypophilic portion of the detergent.

Application EP 1 990 400 discloses lubricant compositions for transmissions in marine applications, comprising a base oil which may be a synthetic or natural oil. The synthetic oils may be polyalphaolefins (PAO), various esters of (di)carboxylic acids and alcohols or polyols, alkyl benzene bases, polysilicons, polymer or copolymer olefins, polyphenols, alkyl diphenyl ethers, alkyl diphenyl sulfides, polyalkylene glycols, Fischer Tropsch bases. These compositions may also comprise at least one metal detergent, which may be selected from sulfonates, phenates, sulfurized phenates and salicylates. No specific combination of PAG bases with salicylates is disclosed. These compositions for marine transmissions exhibit good water emulsification properties as well as anti-wear properties.

Application JP 2007 204451 discloses a polyalkylene glycol which is a tetraether obtained by polymerization of propylene oxide, as well as a diether, for use as a base oil in lubricant compositions, notably for motor oils and in the presence of certain additives, notably detergents. The disclosed tetraethers however have quite low molecular weight and low kinematic viscosity at 100° C. Their use in formulations of motor oil therefore requires their use in combination with other base oils; now these tetraethers only include propylene oxide units, which do not give them much solubility in oils. Moreover, solubilization or keeping them suspended in tetraether bases of additives including a lipophilic portion, such as for example detergents, is likely to pose a problem.

The diether as for it consists of 3 long ($C_6$-$C_{14}$) carbon chains, delimited by two ether functions. The two oxygen atoms of the ether functions are separated from each other by 5 carbon atoms. These bases are therefore not polyalkylene glycols, where by nature, the oxygen atoms are separated by 2 carbon atoms, which corresponds to the attack of the epoxy function of the alkylene oxides during polymerization. It is foreseen that their behavior, notably in terms of polarity, will not have the same advantages as PAGs in an engine formulation. Therefore, there exists a need for lubricant compositions comprising a significant portion of PAG bases, which may comprise so-called oily or lipophilic compounds which are miscible with said PAG bases, and the Noack volatility of which is compatible with a use as motor oil.

For engine lubricants, the Noack volatility, measured according to the CEC L 40-93 standard, is typically less than 15%, preferentially less than 13%. It is typically comprised between 8 and 15%, or further between 10 and 13%. Surprisingly, the applicant noticed that the Noack volatility of certain PAG bases, moreover suitable for use in motor oil, is strongly reduced when they are combined with specific additives. Without having the intention of being bound to any theory, it seems that these additives play a role either on inhibiting the formation of volatile degradation products of the PAGs when these bases are subject to conditions for analyzing Noack volatility, or on stabilizing these degradation products in the oil matrix.

The present invention therefore relates to lubricant compositions comprising these specific combinations of PAG bases and of additives, as well as to their use as a motor oil, notably for automobile vehicles. The present invention also relates to the use of these additives or of additives package containing them in motor oil formulations comprising PAG bases. Finally the present invention also relates to the use of these additives, or of additives packages containing them, in order to reduce the Noack volatility measured according to the CEC L 40-93 standard, of PAG bases.

SUMMARY

The present invention relates to a lubricant composition comprising:

(a) one or several polyalkylene glycol base oils, obtained by polymerization or copolymerization of alkylene oxides comprising 3 to 8 carbon atoms, including at least one butylene oxide, (b) at least one detergent selected from salicylates or phenates.

Preferentially, the polyalkylene glycol base oil(s) (a) are copolymers of butylene oxide and of propylene oxide. Preferentially, the polyalkylene base oil(s) (a) is(are) obtained by reacting at least one alcohol comprising from 8 to 20 carbon atoms and a mixture of butylene oxide and propylene oxide, said mixture having a mass ratio of butylene oxide over propylene oxide comprised between 3:1 and 1:3, preferentially between 3:1 and 1:1.

According to one embodiment, the polyalkylene glycol base oil(s) (a) is(are) such that the alcohol(s) with which they may be obtained include(s) from 8 to 12 carbon atoms. According to one embodiment, the polyalkylene glycol base oil(s) (a) are such that the alcohol(s) with which they may be obtained is(are) selected from monoalcohols preferably from 2-ethylhexanol and/or decanol, preferentially decanol. According to one embodiment, the polyalkylene base oil(s) (a) have a molar ratio of carbon over oxygen of at least 3:1, preferentially comprised between 3:1 and 6:1.

According to one embodiment, the Noack volatility of the composition of the invention measured according to the CEC L 40-93 standard, is less than 15%, preferentially less than 13%. According to one embodiment, the base(s) (a) has(have) a molar mass measured according to the ASTM D2502 standard comprised between 300 and 1,000, preferentially between 350 and 600 grams per mole. According to one embodiment, the kinematic viscosity of the polyalkylene glycol bases at 100° C., measured according to the ASTM D445 standard, is comprised between 1 and 12 cSt, preferentially between 3 and 7, preferentially between 3.5 and 6.5 cSt.

According to one embodiment, the polyalkylene glycol base oils (a) is(are) the majority component. According to one embodiment, the lubricant composition according to the present invention comprises from 20 to 90%, preferentially from 25 to 85% of polyalkylene glycol base oil(s). According to one embodiment, the lubricant composition according to the present invention comprises at least one salicylate as a detergent (b). According to one embodiment, the lubricant composition according to the present invention is free of any detergent of the sulfonate type.

According to one embodiment, the composition according to the present invention further comprises:

(c) at least one dithiocarbamate as an anti-wear additive. According to one embodiment, the lubricant composition according to the present invention is free of anti-wear additive of the dithiophosphate type, in particular of zinc dithiophosphate. According to one embodiment, the lubricant composition according to the invention, further comprises an amine antioxidant and/or a phenol antioxidant.

In another aspect, the invention provides the use of the above-defined lubricant composition as motor oil, preferentially as oil for gasoline or diesel engines of automobile vehicles. Further to another aspect, the present invention provides an use of a additives package comprising:

at least one detergent selected from salicylates or phenates, preferentially salicylates, at least one anti-wear agent of the dithiocarbamate type, at least one amine or phenol antioxidant, as a additives package for an engine lubricant comprising polyalkylene glycol bases obtained by polymerization or copolymerization of alkylene oxides comprising from 3 to 8 carbon atoms, preferably at least one of which is butylene oxide.

According to one preferred embodiment of the use of the additives package, the polyalkylene glycol bases are the above-defined polyalkylene glycol bases (a). According to another preferred embodiment of the use of the additives package, the additives package is free of any anti-wear agent of the dithiophosphate type, in particular zinc dithiophosphate. According to another preferred embodiment of the use of the additives package, the additives package is free of any detergent of the sulfonate type.

According to another preferred embodiment of the use of the additives package, the engine lubricant comprises in majority the above-defined polyalkylene glycol bases (a) as base oils. According to another preferred embodiment of the use of the additives package, the engine lubricant exclusively comprises the above-defined polyalkylene glycol bases (a) as base oils. According to another preferred embodiment of the use of the additives package, the engine lubricant comprises from 20 to 90%, preferentially from 25 to 85% of the above-defined polyalkylene glycol base oil(s) (a).

In another aspect, the present invention provides an use of at least one additive selected from salicylates, phenates, dithiocarbamates, amine or phenol antioxidants, preferentially from salicylates or phenates, for reducing the Noack volatility as measured according to the CEC L 40-93 standard, of the base oils of the polyalkylene glycol type, obtained from alkylene oxides comprising from 3 to 8 carbon atoms, including at least one butylene oxide, preferably the above-defined polyalkylene glycol bases (a). In another aspect, the invention provides a method of lubricating an engine including the use of the lubricating composition as defined above. According to one embodiment of the method of lubrication of the present invention, the engine is an automobile engine, preferably gasoline or diesel.

In another aspect, the invention provides a additives package for its use in polyalkylene glycol bases obtained by polymerization or copolymerization of alkylene oxides containing from 3 to 8 carbon atoms, preferably at least one of which is butylene oxide, said additive package comprising:

- at least one selected from the detergent salicylates or phenolates, preferably salicylates,
- at least one anti-wear type dithiocarbamate,
- at least one amino or phenolic antioxidant.

In another aspect, the invention provides a method for reducing the Noack volatility measured by standard CEC L 40-93 of an polyalkylene glycol base oil, obtained from alkylene oxides containing from 3 to 8 carbon atoms, of which at least one is butylene oxide, preferably where the polyalkylene glycol bases (a) are as defined above, in which at least one additive is added to the polyalkylene glycol base oil, the additive being selected from salicylates, phenolates, dithiocarbamates, amine or phenolic antioxidants, preferably from salicylates or phenolates.

DETAILED DESCRIPTION

Polyalkylene Glycol Bases (a)

Polyalkylene glycol bases (a) of the compositions according to the invention have properties adapted to use in motor oil. These are (random or block) polymers or copolymers of alkylene oxides, for example prepared according to the known methods described in application WO 2009/134716, page 2 line 26 to page 4 line 12, for example by the attack of an alcohol initiator on the epoxy bond of an alkylene oxide and propagation of the reaction.

The polyalkylene glycol (PAG) bases of the composition according to the invention fit the general formula:

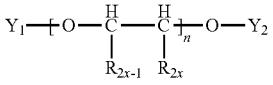

(A)

wherein $Y_1$ and $Y_2$ independently of each other are hydrogen or a hydrocarbon group, for example an alkyl or alkylphenyl group having between 1 and 30 carbon atoms, n represents an integer greater than or equal to 2, preferentially less than 60, preferentially comprised between 5 and 30, preferentially comprised between 7 and 15, x represents one or more integers between 1 and n.

The groups $R_{2x-1}$ and $R_{2x}$ independently of each other are hydrogen or hydrocarbon radicals comprising between 1 and 6 carbon atoms, preferentially alkyls and $R_{ex}$ is preferentially hydrogen. The sum of the numbers of carbon atoms of $R_{2x-1}$ and $R_{ex}$ is comprised between 1 and 6. For at least one value of x, the sum of the number of carbon atoms of $R_{2x-1}$ and $R_{ex}$ is equal to 4.

The alkylene oxides used for the PAG bases of the compositions according to the invention include between 3 and 8 carbon atoms, with at least one butylene oxide, said butylene oxide being 1,2-butylene oxide or 2,3-butylene oxide, preferably 1,2-butylene oxide. Indeed, the PAGs (partly) obtained from ethylene oxide do not have sufficient liphophilicity for being used in motor oil formulations. In particular, they cannot be used in combination with other mineral, synthetic or natural base oils. The neutral or overbased detergents, indispensable for formulating lubricants guaranteeing engine cleanliness, cannot either be solubilized or kept in suspension in these PAG bases (partly) obtained from ethylene oxide.

The use of alkylene oxides comprising more than 8 carbon atoms is not desired either since for producing bases having the molar mass and therefore the viscosimetric grade targeted for engine applications, one would then have a reduced number of monomers (small n in the formulae (A) above), with long side chains $R_{2x-1}$ and $R_{2x}$. This is detrimental to the overall linearity of the PAG molecule and leads to too low viscosity indexes (VI) for a motor oil application. Preferentially, their viscosity indexes VI (measured according to the NFT 60136 standard) is greater than 100, preferentially greater than 120.

In order to give them sufficient lipophilicity, and therefore good solubility in the other synthetic base oils, the mineral or natural base oils, and good compatibility with certain additives indispensable for motor oils, such as detergents, the PAG bases (a) of the compositions according to the invention are obtained from alkylene oxides comprising at least one butylene oxide (BO). Among these PAG bases, the copolymers of butylene oxide (BO) and propylene oxide (PO) will be more preferred, since they have both good tribological and rheological properties of the PAGs containing ethylene oxide units, and good solubility in conventional mineral, synthetic and natural bases and other oily compounds.

Application WO2011/011656, paragraphs [011] to [014] describes the preparation method, the features and properties (notably, solubility and miscibility in base oils) of such butylene oxide/propylene oxide copolymer PAG bases. These bases are prepared in a conventional way, by reacting one or more alcohols with a mixture of butylene oxide and propylene oxide. In order to give the PAGs good solubility and good miscibility in mineral, synthetic and natural base oils, the use in the compositions according to the invention of PAGs prepared with a mixture of butylene oxide and propylene oxide will be preferred, wherein the mass ratio between butylene oxide and propylene oxide is comprised between 3:1 and 1:3. The PAG bases prepared with a mixture where this ratio is comprised between 3:1 and 1:1 are particularly well miscible and soluble in the other base oils, including the synthetic oils of group IV (polyalphaolefins).

According to a preferred embodiment, the PAG bases of the compositions according to the invention are prepared from an alcohol including from 8 to 12 carbon atoms. 2-ethylhexanol and dodecanol, either alone or as a mixture, and in particular dodecanol, are more preferred, since the PAG bases prepared from these alcohols have very low traction coefficients. According to a preferred embodiment, the PAG bases of the compositions according to the invention are such that their carbon-over-oxygen molar ratio is greater than 3:1, preferentially comprised between 3:1 and 6:1. This gives said PAGs bases, polarity and viscosity index properties particularly suitable for use in motor oils.

The molar mass, measured according to the ASTM D2502 standard, of PAG bases of the compositions according to the invention is preferentially comprised between 300 and 1,000 grams per mole (g/mol), preferentially between 350 and 600 g/mol (this is why they contain a limited number n of alkylene oxide units as described above in formula (A)). This gives them kinematic viscosities at 100° C. (KV100) generally comprised between 1 to 2 cSt and 12 cSt at 100° C., preferentially between 3 and 7 cSt, preferentially between 3.5 and 6.5 or between 4 and 6 cSt or between 3.5 and 4.5 cSt. The KV100 of the composition is measured according to the ASTM D445 standard.

The PAG bases are preferentially used as light bases in lubricant compositions for automobile engines according to the invention where they are preferentially associated with viscosity index enhancer polymers (VI improver) and/or other heavier bases. The use of light PAG bases (a) (KV100 approximately between 2 and 6.5 cSt) is preferentially selected in the compositions according to the invention in order to be able to formulate more easily 5 W or 0 W cold grade multi-grade oils according to the SAEJ300 classification, since the heavier PAG bases (a) have cold properties (high CCS) with which it is not possible to easily attain these grades. The PAG bases (a), notably those with KV100 values comprised between 3.5 and 4.5 cSt, of the order of 4 cSt, have Noack volatilities according to the CEC L 40-93 standard of the order of 35 to 40%, which is very high and cannot be caught up in a formulation with viscosity index enhancer polymers (VI improvers) or other less volatile bases.

On the other hand, when they are combined with certain additives in the lubricant compositions according to the invention, their volatility is strongly lowered and is typically located between 15 and 20%, which is the order of magnitude of mineral, synthetic or natural bases typically used in motor oil formulations. With this volatility level of the bases, it is possible to formulate finished engine lubricants having volatility comprised between 10 and 15%, by mixture with viscosity index enhancer polymers (VI improvers) and optionally with other heavier bases, which is compatible with the requirements specification of this type of product.

The lubricant composition according to the invention preferentially have a Noack volatility measured according to the CEC L 40-93 standard, of less than 15%, preferentially less than 13%. It is typically comprised between 8 and 15%, or further between 10 and 13%. Preferentially, in the compositions according to the invention, the PAG base(s) (a) is(are) the majority base(s). This means that the mass percentage of the PAG base (a) or the mass percentage of the accumulation of the PAG bases (a) is greater than the mass percentage of each of the other bases present in the compositions according to the invention; the mass percentages being expressed on the basis of the total weight of lubricant composition.

Preferentially, in the compositions according to the invention, the PAG base(s) (a) is(are) the majority component(s). This means that the mass percentage of the PAG base (a), or the mass percentage of the accumulation of PAG bases (a) is greater than the mass percentage of each of the other components present in the compositions according to the invention; the mass percentages are expressed on the basis of the total weight of lubricant composition. According to an embodiment, in the compositions according to the embodiment, the PAG base(s) (a) represent(s) between 20 and 90% by weight, preferentially between 25% and 85% by weight, preferentially between 30 and 80% by weight or further between 50 and 75% by weight of the lubricant compositions according to the invention.

Detergents (b), Salicylates and Phenates

The detergents used in the lubricant compositions according to the present invention are well known to one skilled in the art. The detergents commonly used in the formulation of lubricant compositions are typically anionic compounds including a long lipophilic hydrocarbon chain (typically comprising at least 9, preferentially at least 12 carbon atoms) and a hydrophilic head. The associated cation is typically a metal cation of an alkaline metal, preferentially lithium, sodium or potassium.

The detergents (b) of the compositions according to the invention are selected from the salts of alkaline or earth alkaline metals of the salicylate and phenate type. These metal salts may contain the metal in an approximately stoichiometric amount. In this case, these are referred to as non-overbased or "neutral" detergents, although they also provide some basicity. These "neutral" detergents typically have a base number (BN), measured according to ASTM D2896, of less than 150 mg KOH/g or less than 100, or even less than 80 mg KOH/g.

When the metal is in excess (in an amount above the stoichiometric amount), we are dealing with so-called overbased detergents. Their BN is high, greater than 150 mg KOH/g, typically comprised between 200 and 700 mg KOH/g, generally comprised between 250 and 450 mg KOH/g. The excess metal providing the overbasicity to the detergent appears in the form of metal salts insoluble in the oil, for example a carbonate, hydroxide, oxalate, acetate, glutamate, preferentially carbonate. Overbased detergents in the form of micelles consisting of insoluble metal salts maintained in suspension in the lubricant composition by the detergents in the form of metal salts soluble in the oil.

The lubricant compositions according to the invention contain at least one detergent of the alkaline or earth alkaline metal salicylate type or at least one detergent of the alkaline or earth alkaline metal phenate type, either neutral or overbased by the aforementioned metal salts insoluble in the oil. According to an embodiment, they contain at least one salicylate detergent and at least one phenate detergent. Preferentially, the amounts of detergents included in the lubricant compositions according to the invention are adjusted so that the BN of said compositions, as measured according to the ASTM D2896 standard, is comprised between 3 and 12 mg of KOH per gram of lubricant, preferentially comprised between 5 and 10, preferentially between 6 and 9 mg of KOH per gram of lubricant. Typically, the amount of phenate and/or salicylate detergents included in the lubricant compositions according to the invention will be comprised between 0.2 and 1.5%, preferentially between 0.5 and 2% by mass.

Typically, the salicylates and phenates used as detergents (b) in the lubricant compositions according to the invention are prepared from salicylic acid and phenol derivatives fitting the formulae (I) and (II) below:

(I)

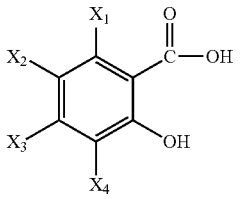

(II)

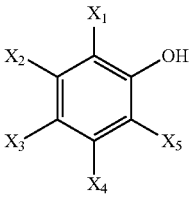

wherein $X_1$, $X_2$, $X_3$, $X_4$, $X_5$ are either hydrogen or hydrocarbon radicals, preferentially alkyls, or alkyl aryls, or aryl alkyls, and at least one of the groups $X_1$, $X_2$, $X_3$, $X_4$, $X_5$ is a hydrocarbon radical having a sufficient amount of carbon atoms (typically at least about 9 carbon atoms, preferentially at least 12 carbon atoms), in order to give the salicylate, solubility in oil, and M is an alkaline metal.

One of the groups $X_1$ to $X_5$ may for example be a linear or branched alkyl group comprising at least 9 carbon atoms, preferentially between 10 and 160, preferentially between 12 and 40, preferentially between 14 and 28 carbon atoms. According to an embodiment, at least one of the groups $X_1$ to $X_5$ is a linear alkyl comprising at least 9 carbon atoms, preferentially between 10 and 160, preferentially between 12 and 40, preferentially between 14 and 28 atoms or between 18 and 24 carbon atoms. These detergents may be neutral, or overbased by salts of alkaline metals insoluble in oil, such as carbonates, hydroxides, oxalates, acetates, glutamates.

The detergents (b) of the compositions according to the invention may be neutral or overbased salicylates, fitting the formulae (III), (IV), (V), below, wherein $X_1$, $X_2$, $X_3$, $X_4$, $X_5$ are as defined above, and $X_6$ and $X_7$ also have the same meaning, $M_1$ is an alkaline metal, preferentially selected from sodium, potassium, lithium, and $M_2$ is an earth alkaline metal, preferentially selected from calcium or magnesium.

(III)

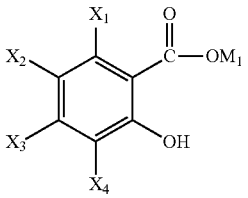

(IV)

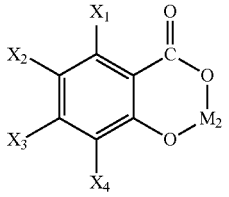

(V)

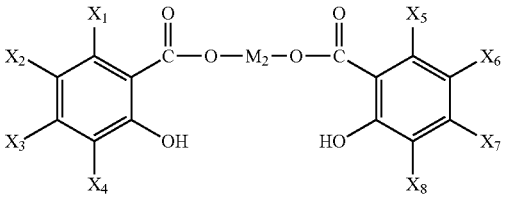

The detergents of formula (III) and methods for producing them are for example described in the application EP 1 548 089. The detergents of formulae (IV) and (V) and methods for producing them are for example described in the applications U.S. Pat. No. 6,348,438, and WO 2004/041767, and EP 0786 448. The application WO 2004/009747 also describes detergents of the earth alkaline metal salicylate type which may be used as a detergent (b) in the compositions according to the invention.

The detergents (b) of the compositions according to the invention may be phenates, either neutral or overbased, fitting the formulae (VI), (VII), (VIII), below, wherein $X_1$, $X_2$, $X_3$, $X_4$, $X_5$, $X_6$, $X_7$ are as defined above and $X_8$ and $X_9$ have the same meaning, $M_1$ is an alkaline metal, preferentially selected from sodium, potassium, lithium and $M_2$ is an earth alkaline metal, preferentially selected from calcium or magnesium.

(VI)

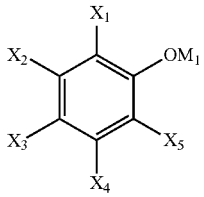

(VII)

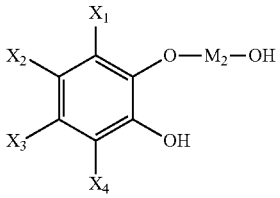

(VIII)

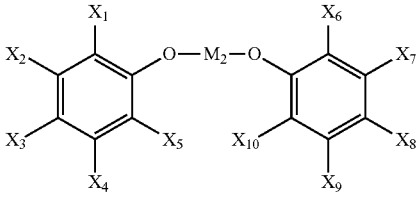

The detergents of formula (VI) and (VII) and (VIII) and methods for producing them are for example described in applications EP 2 055 761, and EP 0 786 448.

Sulfurized derivatives of salicylates and phenates, described above, may also be used as detergents (b). These sulfurized derivatives and methods for producing them are for example described in applications EP 2 055 761 and EP 0786 448. The latter application also describes mixed sulfurized phenate salicylate detergents, fitting formula (IX) which may also be used as detergent (b) in the compositions according to the invention.

(IX)

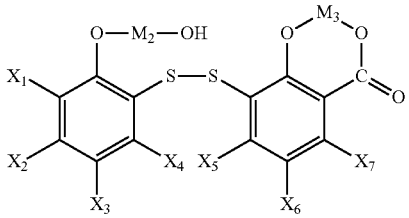

wherein $X_1$ to $X_7$ are as defined above, $M_2$ and $M_3$ are earth alkaline metals preferentially selected from calcium or magnesium.

In the compositions according to the invention, salicylate and phenate detergents (b) may be used alone or as a mixture. They may be present in combination with other detergents known to one skilled in the art, such as for example other carboxylates. However it is preferable to avoid the presence of detergents of the sulfonate type which are difficult to solubilize in the PAG bases, in particular when the PAG base(s) form(s) the sole base oil(s) of the composition, or when the PAG base(s) form(s) the majority base oil(s) of the composition, or when the PAG base(s) form(s) at least 20% by weight of the lubricant composition. According to an embodiment, and in particular in the last three cases, the compositions according to the invention are free of sulfonate detergents.

Dithiocarbamates (c):

The lubricant compositions according to the invention may contain one or more dithiocarbamate additives (c). Dithiocarbamates are well known to one skilled in the art as multifunctional additives for lubricants, in particular providing anti-wear properties, but also antioxidant, extreme pressure and friction modifier properties. Dithiocarbamates used in the compositions according to the invention are for example described in the applications EP 1 730 107, WO 2005/007786, U.S. Pat. No. 4,997,969.

The compositions according to the invention may also contain molybdenum dithiocarbamates, friction modifier additives for motor oils, well-known to one skilled in the art. These molybdenum dithiocarbamate organometallic friction modifiers may for example fit formula (XI):

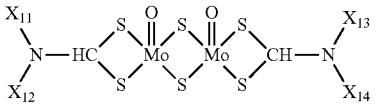

(XI)

wherein X11, X12, X13, X14 are alkyl chains, preferentially including from 8 to 13 carbon atoms.

In the compositions according to the invention, dithiocarbamates (c) may be used alone or as a mixture. They may be present in combination with other anti-wear, extreme pressure or friction modifier additives known to one skilled in the art. However it is preferable to avoid the presence of an anti-wear agent of the dithiophosphate type, in particular zinc dithiophosphates which are difficult to solubilize in the PAG bases, in particular when the PAG base(s) form(s) the only base oil(s) of the composition or the majority base oil(s), or when the PAG base(s) form(s) at least 20% by weight of the lubricant composition. According to an embodiment, and in particular in these last three cases, the compositions according to the invention are without any anti-wear agent of the dithiophosphate type, in particular zinc dithiophosphates.

Amine or Phenol Antioxidants (d):

The lubricant compositions according to the invention may optionally comprise amine or phenol antioxidants, either alone or as a mixture. These are phenols or secondary amines, the amine and phenol function is sterically hindered, as well-known to one skilled in the art for their antioxidant action in lubricants. The phenol antioxidants of the compositions according to the invention are phenols substituted on at least one, preferably both, of their ortho positions, with alkyl groups comprising from 1 to 10 carbon atoms, for example methyl, isopropyl or tertiobutyl groups, preferentially with 1 to 3 carbon atoms. They may also be used as dimers.

The amine antioxidants of the compositions according to the invention are secondary amines, the nitrogen atom of which is connected to at least one aryl group. Preferentially, these are secondary amines of formulae R8—NH—R9, wherein R8 and R9 independently of each other are:

- a phenyl group optionally substituted, preferably in the para position of the amine function, with alkyl or alkenyl groups including from 1 to 10 carbon atoms, preferentially from 1 to 3 carbon atoms,
- a naphthyl group optionally substituted with alkyl or alkenyl groups including from 1 to 10 carbon atoms, preferentially from 1 to 3 carbon atoms, or else R8 is a phenyl group, and R9 forms with the nitrogen atom of the amine function and the R8 cycle, a $C_6$ heterocycle, optionally substituted with alkyl groups.

Other Base Oils:

The lubricant compositions according to the present invention may comprise, in combination with the PAG bases (a) described above, one or several other base oils, which may be oils of mineral or synthetic origin of groups I to V according to the classes defined in the API classification (or their equivalents according to the ATIEL classification) as summarized below, alone or as a mixture.

| | Saturated content | Sulfur content | Viscosity index (VI) |
|---|---|---|---|
| Group 1 mineral oils | <90% | >0.03% | 80 ≤ VI < 120 |
| Group II hydrocracked oils | ≥90% | ≤0.03% | 80 ≤ VI < 120 |
| Group III hydrocracked or hydro-isomerized oils | ≥90% | ≤0.03% | ≥120 |
| Group IV | Polyalphaolefins (PAO) | | |
| Group V | Esters and other bases not included in the bases of groups I to IV | | |

These oils may be oils of vegetable, animal origin or mineral oils. The mineral base oils of the compositions according to the invention include all types of bases obtained by atmospheric and vacuum distillation of crude oil, followed by refining operations such as extraction with a solvent, deasphalting, deparaffining with a solvent, hydrotreatment, hydrocracking and hydroisomerization, hydrofinishing. The other base oils of the compositions according to the present invention may also be synthetic oils, such as certain esters of carboxylic acids and alcohols, GTL bases which may be obtained by hydroisomerization of a Fischer-Tropsch wax, or polyalphaolefins. The polyalphaolefins used as base oils, are for example obtained from monomers having from 4 to 32 carbon atoms (for example octane, decene), and have a viscosity at 100° C. comprised between 1.5 and 15 cSt. Their average weight molecular mass is typically comprised between 250 and 3,000.

Preferably, the lubricant compositions according to the present invention have a kinematic viscosity at 100° C. comprised between 5.6 and 16.3 cSt measured by the ASTM D445 standard, (SAE grade 20, 30 and 40), preferentially comprised between 9.3 and 12.5 cSt (grade 30). According to a more preferred embodiment, the compositions according to the present invention are multi-grade oils of grade 5 W or 0 W according to the SAEJ300 classification. The compositions according to the present invention preferably also have a viscosity index VI greater than 130, preferentially greater than 150, preferentially greater than 160.

Other Additives:

The lubricant compositions according to the invention may also contain all types of additives suitable for their use, in particular as a motor oil, preferentially for an automobile vehicle engine. These additives may be added individually or else as additives package, guaranteeing a certain performance level to the lubricant compositions, as required for example by the EAMA (European Automobile Manufacturers' Association). These are for example and in a non-limiting way:

- dispersants, such as for example succinimides, PIB (polyisobutene) succinimides, Mannich bases. They ensure the maintaining in suspension and removal of the insoluble solid contaminants formed by the secondary oxidation products which form when the motor oil is in operation.

antioxidants which delay the degradation of the operating oils, a degradation which may be expressed by the formation of deposits, the presence of sludges, or an increase in the viscosity of the oil. They act as radical inhibitors or destructive agents of hydroperoxides. Among the currently used antioxidants, are found antioxidants of the phenol type, of the sterically hindered amine type. Another class of antioxidants is that of soluble copper compounds in the oil, for example copper thio- or dithio-phosphates, copper carboxylic acid salts, copper dithiocarbamates, sulfonates, phenates, acetylacetonates. Copper (I) and (II) succinic acid or anhydride salts are used.

anti-wear additives protect the frictional surfaces by forming a protective film adsorbed on these surfaces, various phosphorus, sulfur, nitrogen, chlorine or boron compounds are found in this category.

and also anti-foam agents, viscosity index enhancer polymers (VI improver), flow point lowering agents, corrosion inhibitors, . . . .

In the lubricant compositions according to the invention, all the additives, for example those described above, including the detergents (b), the dithiocarbamates (c), the antioxidants (d) are preferentially used in the usual mass contents of formulations for motor oils.

EXAMPLES

The Noack volatility of polyalkylene glycol bases (PAG) alone or in the presence of additives was measured according to the CEC L 40-93 standard. The mass compositions and Noack volatility of the different samples are given in Table 1 and Table 2 hereafter.

Table 1 relates to PAG and mineral base oils, either alone or as a mixture. A is a polyalkylene glycol (PAG), obtained from alkylene oxides, in particular butylene oxide (BO) and propylene oxide (PO) with a mass ratio of BO/PO of 50/50, with a molar mass of 388 g/mol according to ASTM D2502, with a kinematic viscosity at 100° C. (KV100) of 3.982 $m^2/s$ according to ASTM D445, with a viscosity index (VI) of 118. Its Noack volatility is very high (39.4%) as compared with a mixture of mineral bases of group III (cf. Table 1, A1, Noack of 11.2%). By mixing PAG base A with mineral bases of group III it is possible to obtain an intermediate Noack volatility (cf. Table 1, A2, Noack of 22%).

Table 2 relates to compositions comprising PAG bases alone or in the presence of additives. The compositions B1 and B3 are compositions according to the invention containing an additives package which comprises a salicylate detergent, a dithiocarbamate anti-wear agent, an amine antioxidant and a phenol antioxidant. The Noack volatility is of the order of magnitude of that of known motor oils.

The composition B1 comprises a mixture of PAG bases and of mineral bases of Group III comparable with the mixture of bases A2. If the Noack volatility of B1 (14%) is compared with that of A2 (22%), it is seen that the presence of additives allows strong lowering of the Noack volatility. The composition B2 also comprises a mixture of PAG bases and of mineral bases of Group III, comparable with the mixture of bases A2. B2 does not comprise any salicylate or phenate additives and is not according to the invention. B2 comprises a viscosity index enhancer polymer (VI improver) on the other hand.

If the Noack volatility of B2 (21.3%) is compared with that of A2 (22%), it is seen that the effect of the viscosity index enhancer polymer (VI improver) on the Noack volatility is zero or close to it. The lowering of volatility observed in B3 (11%) is actually due to the effect of the additives of the package and not to the viscosity index enhancer polymer (VI improver). This effect is reinforced by adding a viscous PAO base.

The compositions C to K contain the PAG base A combined with various additives. The compositions F and G are compositions according to the invention. Their Noack volatility is of the order of magnitude of those of light base oils conventionally used in the formulation of motor oils.

The samples H, J, K also have strongly lowered Noack volatility with respect to that of the base A, by the respective presence of dithiocarbamate, of an amine antioxidant, a phenol antioxidant, and confirm the possibility of using these additives according to the invention for lowering the Noack volatility of a PAG base comprising at least one butylene oxide unit. L is a polyalkylene glycol (PAG) base, obtained from ethylene and propylene oxides, with a molar mass of 388 g/mol, with a KV100 of 3.981 $mm^2/s$, with a viscosity index of 119. Its Noack volatility is very high (37.4%).

The composition M, which contains the base L and a phenol antioxidant, has its volatility strongly lowered to a level of the order of magnitude of those of light base oils conventionally used in the formulation of motor oils. The sample N demonstrates that the base L does not solubilize the salicylate detergents. O is a polyalkylene glycol (PAG) base, obtained from propylene oxide (PO 100%), with a molar mass of 750 g/mol, with a KV100 of 6 cSt, with a viscosity index VI of 179.

The composition P contains the base named O and 1% detergent phenate. The sample P shows that the base named O, which does not contain butylene oxide units, does not dissolve detergents, especially phenolates, contrary to the base A in the composition F.

The composition B5 comprises the base named O in a motor oil formulation. Again, this composition B5 demonstrates that the base named O does not solubilize additives packages traditionally used and/or the base named O is not compatible with the base oils used traditionally. The same is observed with the composition B4 comprising the base L in a motor oil formulation. Only, the base A used in a formulation motor (see composition B3) allows compatibility, solubility with base oils and additives.

TABLE 1 mass percentages and Noack

| | A | A1 | A2 |
|---|---|---|---|
| PAG with BO (BO/PO: 50/50) (KV100 = 4 cSt) | 100% | | 38.3% |
| Base group III UCBO4R KV100 = 4.135 cSt | | 77.4% | 50.8% |
| Base group III UCBO7R KV100 = 6.918 $mm^2/s$ | | 22.6% | 10.9% |
| Noack, CEC L 40-93 Standard | 39.4% | 11.2% | 22.02% |

TABLE 2

| | A | B1 | B2 | B3 | C | D | E | F | G |
|---|---|---|---|---|---|---|---|---|---|
| PAG with butylene oxide BO/PO KV100 = 4 cSt | 100% | 31.9% | 35.6% | 30% | 99% | 99% | 49.5% | 99% | 99% |
| PAG with ethylene oxide EO/PO KV100 = 4 cSt | | | | | | | | | |
| VI enhancer polymer | | | 7.1% | 6% | | | | | |
| Base group I KV100 4 cSt | | 42.3% | 47.2% | 48.3% | | | | | |
| Base group III KV100 7 cSt | | 9.1% | 10.1% | | | | | | |
| PAO 4 KV100 4 cSt | | | | | | | 49.5% | | |
| Additives package | | 16.7% | | 15.7% | | | | | |
| Succinimide dispersant | | | | | 1% | | | | |
| Amine antioxidant | | | | | | | | | |
| Phenol antioxidant | | | | | | | | | |
| Sulfonate detergent | | | | | | 1% | 1% | | |
| Phenate detergent | | | | | | | | 1% | |
| Salicylate detergent | | | | | | | | | 1% |
| Dithiocarbamate anti-wear agent | | | | | | | | | |
| Zinc dithiophosphate anti-wear agent | | | | | | | | | |
| Noack volatility CEC L 40-93 | 39.4% | 14% | 21.3% | 11% | 39% | Detergent insoluble in PAG | PAO/PAG demixing | 20% | 16% |

| | H | I | J | K | L | M | N |
|---|---|---|---|---|---|---|---|
| PAG with butylene oxide BO/PO KV100 = 4 cSt | 99% | 99% | 99% | 99% | | | |
| PAG with ethylene oxide EO/PO KV100 = 4 cSt | | | | | 100% | 99% | 99% |
| VI enhancer polymer | | | | | | | |
| Base group I KV100 4 cSt | | | | | | | |
| Base group III KV100 7 cSt | | | | | | | |
| PAO 4 KV100 4 cSt | | | | | | | |
| Additives package | | | | | | | |
| Succinimide dispersant | | | | | | | |
| Amine antioxidant | | | 1% | | | | |
| Phenol antioxidant | | | | 1% | | 1% | |
| Sulfonate detergent | | | | | | | |
| Phenate detergent | | | | | | | |
| Salicylate detergent | | | | | | | 1% |
| Dithiocarbamate anti-wear agent | 1% | | | | | | |
| Zinc dithiophosphate anti-wear agent | | 1% | | | | | |
| Noack volatility CEC L 40-93 | 21% | Poor solubilisation and hot deposits | 22% | 22% | 37.4% | 20.9% | Detergent Insoluble in PAG |

| | B4 | B5 | O | P |
|---|---|---|---|---|
| PAG with butylene oxide BO/PO KV100 = 4 cSt | | | | |
| PAG with ethylene oxide EO/PO KV100 = 4 cSt | 30% | | | |
| PAG PO 100% KV100 = 6 cSt | | 30% | 100% | 99% |
| VI enhancer polymer | 6% | 6% | | |
| Base group I KV100 4 cSt | 48.3% | 48.3% | | |
| Base group III | | | | |

TABLE 2-continued

| | | | | |
|---|---|---|---|---|
| KV100 7 cSt | | | | |
| PAO 4 | | | | |
| KV100 4 cSt | | | | |
| Additives package | 15.7% | 15.7% | | |
| Succinimide dispersant | | | | |
| Amine antioxidant | | | | |
| Phenol antioxidant | | | | |
| Sulfonate detergent | | | | |
| Phenate detergent | | | | 1% |
| Salicylate detergent | | | | |
| Dithiocarbamate anti-wear agent | | | | |
| Zinc dithiophosphate anti-wear agent | | | | |
| Noack volatility CEC L 40-93 | Cloudy | Cloudy | — | Cloudy |

The invention claimed is:

1. A lubricant composition comprising:

(a) a single base oil of the lubricant composition consisting of:

(i) at least one polyalkylene glycol base oil obtained by reacting at least one alcohol comprising from 8 to 20 carbon atoms and a mixture of butylene oxide and propylene oxide, the mixture having a mass ratio of butylene oxide over propylene oxide comprised between 3:1 and 1:3, said polyalkylene glycol base oil having a molar mass measured according to the ASTM D2502 standard comprised between 300 and 1,000 grams per mole, and a kinematic viscosity at 100° C. measured according to the ASTM D445 standard comprised between 1 and 12 cSt, wherein lubricant composition is devoid of a polyalkylene glycol obtained or partly obtained from ethylene oxide, (ii) at least one oil of API group classification III, and (iii) optionally at least one oil of API group classification I, II, or IV; and (b) from 0.2 to 2% of at least one detergent selected from salicylates or phenates.

2. The composition according to claim 1, wherein the polyalkylene glycol base oil (i) is such that the alcohol with which it may be obtained includes from 8 to 12 carbon atoms.

3. The composition according to claim 1, wherein the polyalkylene glycol base oil (i) is such that the alcohol with which it may be obtained is selected from monoalcohols.

4. The composition according to claim 1, wherein the polyalkylene base oil (i) has a mass ratio of carbon over oxygen of at least 3:1.

5. The lubricant composition according to claim 1, wherein a Noack volatility, measured according to a CEC L 40-93 standard, is less than 15%.

6. The lubricant composition according to claim 1, wherein the polyalkylene glycol base oil (i) is a majority component.

7. The lubricant composition according to claim 1, comprising from 20 to 90% of polyalkylene glycol base oil (i).

8. The lubricant composition according to claim 1 comprising at least one salicylate as a detergent (b).

9. The lubricant composition according to claim 1 free of any detergent of the sulfonate type.

10. The lubricant composition according to claim 1 further comprising:

(c) at least one dithiocarbamate as an anti-wear additive.

11. The lubricant composition according to claim 1 free of anti-wear additive of the dithiophosphate type.

12. The lubricant composition according to claim 1, further comprising an amine antioxidant and/or a phenol antioxidant.

13. The lubricant composition according to claim 1 which is motor oil.

14. A method of using at least one additive for engine oil, the method comprising:

providing the engine oil comprising an additive selected from salicylates, phenates, dithiocarbamates, amine or phenol antioxidants, for reducing the Noack volatility as measured according to a CEC L 40-93 standard, and a single base oil consisting of (a) base oils of a polyalkylene glycol type obtained by reacting at least one alcohol comprising from 8 to 20 carbon atoms and a mixture of butylene oxide and propylene oxide, the mixture having a mass ratio of butylene oxide over propylene oxide comprised between 3:1 and 1:3, said polyalkylene glycol base oil having a molar mass measured according to the ASTM D2502 standard comprised between 300 and 1,000 grams per mole, and a kinematic viscosity at 100° C. measured according to the ASTM D445 standard comprised between 1 and 12 cSt; (b) at least one oil of API group classification III; and (c) optionally at least one oil of API group classification I, II, or IV, wherein the engine oil is devoid of a polyalkylene glycol obtained or partly obtained from ethylene oxide, and lubricating an engine with the engine oil including the additive.

* * * * *